United States Patent [19]

Emori

[11] Patent Number: 4,943,832

[45] Date of Patent: Jul. 24, 1990

[54] IMAGE FORMING APPARATUS

[75] Inventor: Kiyoshi Emori, Osaka, Japan

[73] Assignee: Minolta Camera Kabushiki Kaisha, Osaka, Japan

[21] Appl. No.: 362,576

[22] Filed: Jun. 7, 1989

[30] Foreign Application Priority Data

Jun. 9, 1988 [JP] Japan ..... 63-142084
Jun. 9, 1988 [JP] Japan ..... 63-142085

[51] Int. Cl.[5] ..... G03G 15/00

[52] U.S. Cl. ..... 355/313; 355/319; 355/244; 355/77

[58] Field of Search ..... 355/313, 318, 319, 244, 355/23, 24, 77; 271/3.1

[56] References Cited

U.S. PATENT DOCUMENTS 4,488,801 12/1984 Gibson ..... 355/3 SH
4,499,500 2/1985 Nagashima ..... 358/296
4,568,169 2/1986 Wada et al. ..... 355/3 SH
4,591,884 5/1986 Miyamoto et al. ..... 346/153.1
4,743,945 5/1988 Ito et al. ..... 355/244
4,752,809 6/1988 Ito ..... 355/218
4,771,318 9/1988 Noguchi et al. ..... 355/319 X
4,772,917 9/1988 Tani ..... 355/319 X
4,783,681 11/1988 Tanaka ..... 355/14 R

FOREIGN PATENT DOCUMENTS 59-10958 1/1984 Japan .

*Primary Examiner*—R. L. Moses
*Attorney, Agent, or Firm*—Willian Brinks Olds Hofer Gilson & Lione

[57] ABSTRACT

A plurality of image forming modes are selected by an operator for repeatedly forming images on sheets successively fed in the same image forming section by using circular transport paths having different length of path. It is so controlled as to regulate the maximum number of sheets to remain in a circular transport path corresponding to a selected image forming mode and a selection made on the length of a sheet.

38 Claims, 12 Drawing Sheets

IMAGE FORMING APPARATUS

BACKGROUND OF THE INVENTION

1. Field of the Invention

The present invention relates to an image forming apparatus for forming images on a sheet of paper being transported through a sheet transport path such as electrophotographic copying machines and printers, and more particularly to an image forming apparatus which performs a plurality of image forming operations on one sheet of paper.

2. Description of Related Art

As image forming apparatus such as electrophotographic copying machines and printers, it is well known that the apparatus is provided with a both-side mode for forming images on both sides of a copy sheet and a composite mode for forming images a plurality of times on one side of a copy sheet.

In such an apparatus, there is one which is provided, for instance, with a paper re-feeding transport path where a sheet of paper discharged from an image forming path in which the paper is transported for forming images thereon is returned to the image forming path again. In this paper re-feeding transport path, a paper is returned as it is when composite mode is carried out, and in case of both-side mode, a paper is switched back to return by inverting the paper.

However, when an image fOrming operation is successively carried out for forming images on both sides of a plurality of sheets of paper, for instance, if both-side image forming operation is performed one sheet by one sheet, the image forming operation is suspended while a sheet is being transported in the paper re-feeding transport path. It, therefore, causes to considerably lower throughput, i.e. the number of sheets per unit hour which can be processed in the image forming operation.

U.S. Pat. No. 4,499,500 and U.S. Pat. No. 4,568,169 disclose the image forming apparatus capable of solving such defects. The apparatus disclosed in the U.S. Pat. No. 4,499,500 is arranged to feed another sheet of paper for image forming process when a sheet is being transported in the paper re-feeding transport path, while the apparatus disclosed in the U.S. Pat. No. 4,568,169 is arranged to store a plurality of sheets of paper both in the image forming path and the paper re-feeding transport path with further arrangement of varying transport spaced in the paper re-feeding transport path corresponding to the size and the number of sheets stored.

Generally, however, the maximum number of sheets which can be stored in the paper transport path varies according to the size of paper to be transported, interval between papers and the length of paper transport path selected, etc. Accordingly, in the apparatus disclosed in the U.S. Pat. No. 4,499,500, the number of sheets of paper to be stored can only be set based on the least condition. It is, therefore, impossible to carry out effective image forming operations corresponding to every possible image forming condition.

The apparatus disclosed in the U.S. Pat. No. 4,568,169 is capable of optionally setting the number of sheets of paper to be stored by selecting a transport speed in the paper re-feeding path. For instance, however, it is difficult for the operator to judge the maximum storable number of sheets of paper taking into account the various conditions as above-mentioned. Accordingly, in setting a storable number of sheets of paper, it is preferable to select the number of sheets within a range of storable number of sheets under the least condition for preventing troubles. In this regard, the apparatus disclosed in the U.S. Pat. No. 4,568,169 has the same problem as that of the U.S. Pat. No. 4,499,500.

SUMMARY OF THE INVENTION

The main object of the present invention is to provide an image forming apparatus capable of carrying out image forming operations at high throughput under any image forming condition without trouble.

Another object of the present invention is to provide an image forming apparatus with high efficiency by minimizing a lo s of time originating in the sheet transport.

A further object of the present invention is to provide an image forming apparatus which performs image forming operations at high throughput without inviting trouble under any mode in an image forming apparatus capable of forming images either by composite mode or both-side mode.

Still another object of the present invention is to provide an image forming apparatus capable of carrying out image forming operations with the most high efficiency without changing sheet transport speed even if the size of paper to be used is changed.

In order to accomplish the above-mentioned objects, the image forming apparatus of the present invention is mainly characterized in that when two rounds of image forming operations are carried out on a sheet of paper, a plurality of sheets are divided into each set consisting of a predetermined number of sheets and after a first round of image forming operation is carried out for all sheets of the set, each sheet of the set is returned to an image forming means to proceed to a second round of image forming operation, and such action is repeatedly conducted on each set. It is also characterized in that there are provides a means to judge the maximum number of sheets which can remain in the sheet transport path provided for the first and second rounds of image forming operations based on the distance from the leading edge of a sheet to the leading edge of a sheet followed in the same set and a means to change the predetermined number of sheets to be included in the set corresponding to the result of the judgment made by the judging means.

In order to accomplish the above-mentioned objects, the image forming apparatus of the present invention is further characterized in that the apparatus is provided with a means for selecting a plurality of image forming modes where the maximum number of sheets which can remain on the sheet transport path differs between a composite mode for repeatedly forming images on the same surface of a sheet and a both-side mode for forming images on both sides of a sheet when two rounds of image forming operations are carried out on a sheet of paper, and a controlling means for changing the maximum number of sheets which can remain in the sheet transport path corresponding to the image forming mode selected by the selecting means.

These and other objects and features of the present invention will become more apparent from the following description taken in conjunction with the preferred embodiments thereof with reference to the accompanying drawings.

BRIEF OF THE DRAWINGS

FIGS. 4(*a*) thru FIG. 4 (*d*) are time charts for sheet transport.

Figure 5:
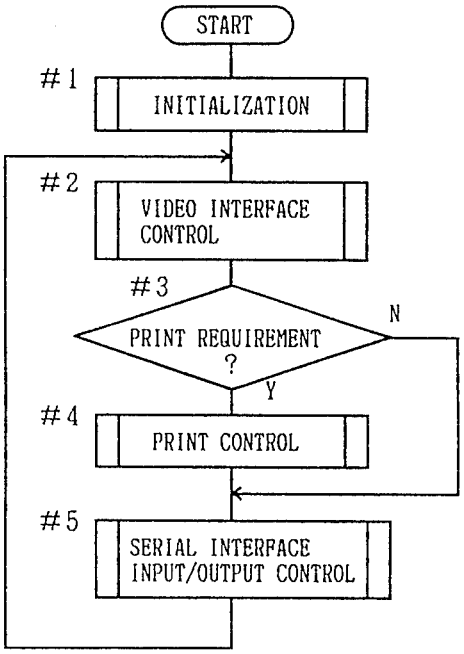

FIG. 5 is a main flow chart of control.

Figure 6A:
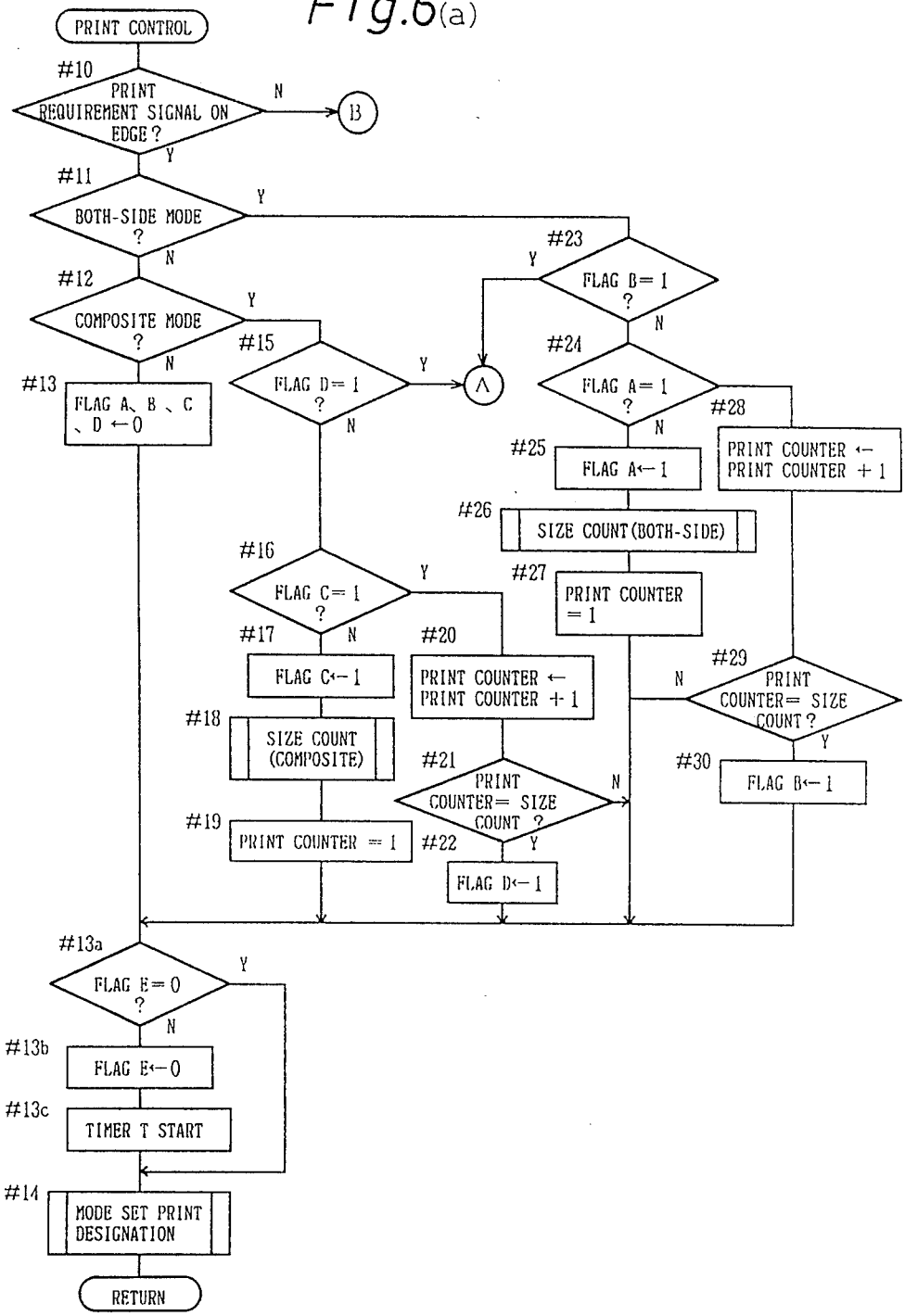
Figure 6B:
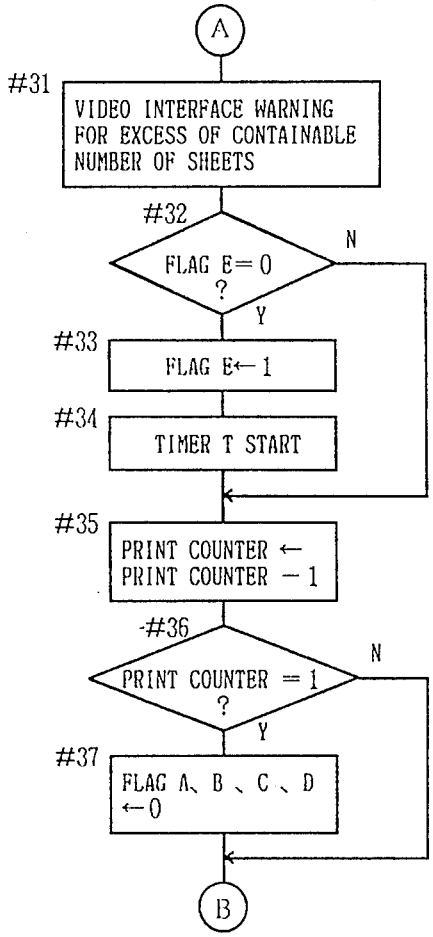

FIG. 6(*a*) and FIG. 6(*b*) are print control subroutines.

Figure 7A:
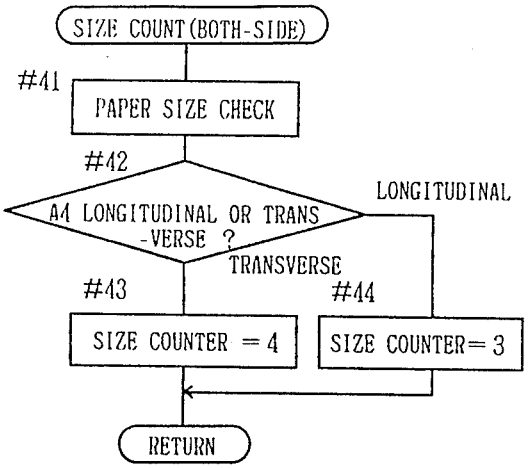
Figure 7B:
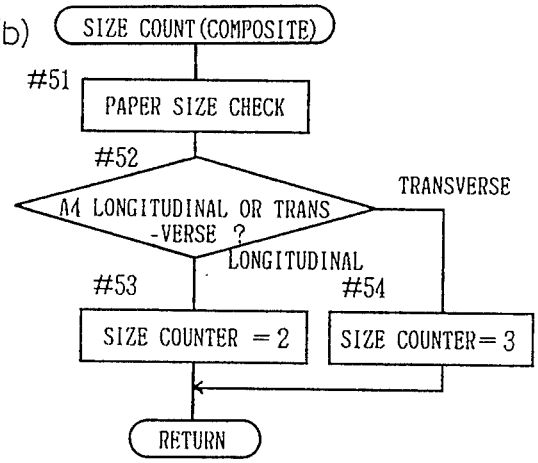

FIG. 7(*a*) FIG. 7(*b*) are flow, charts of size count subroutine in a both-side mode and size count subroutine in a composite mode.

Figure 8:
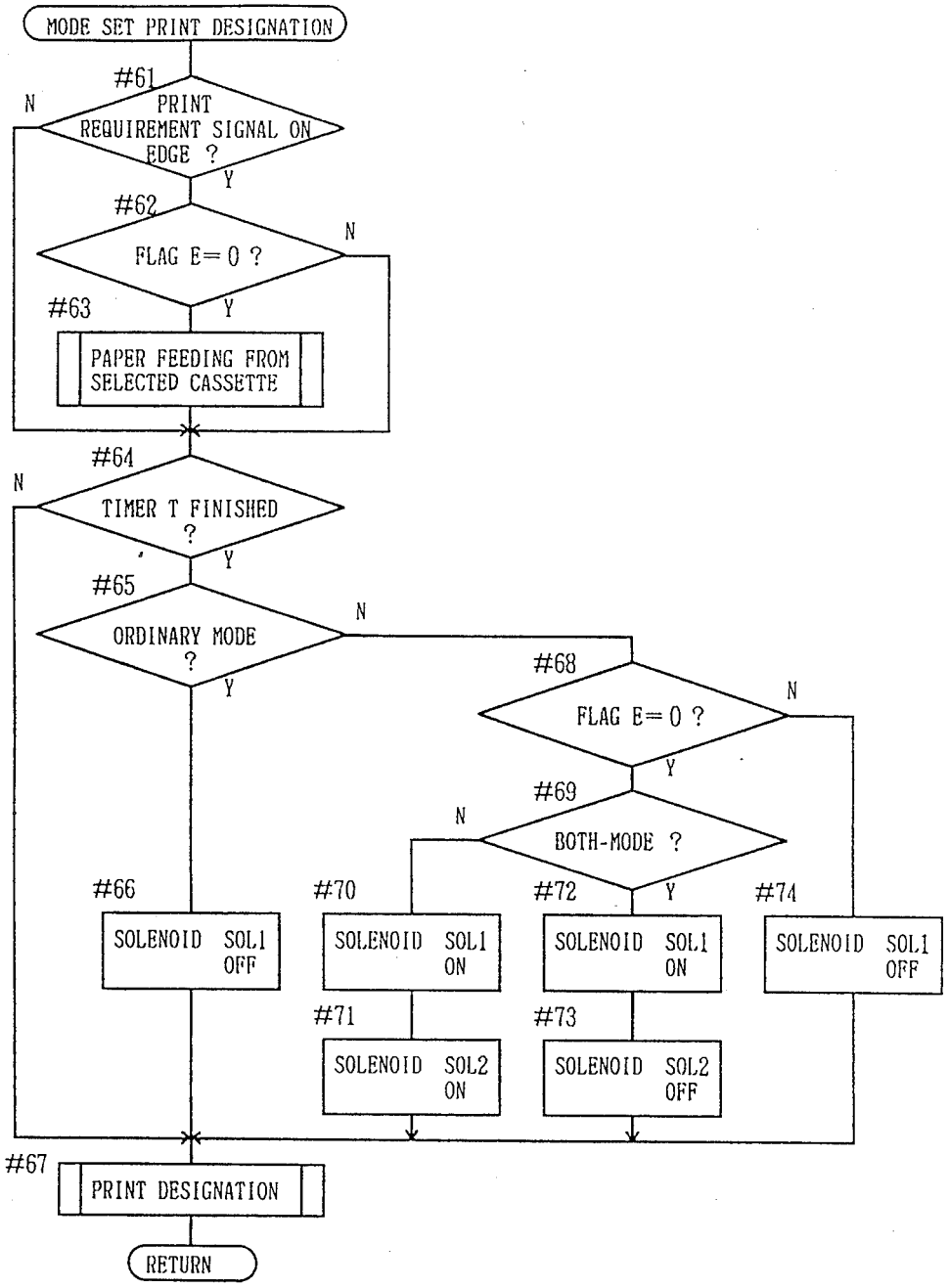

FIG. 8 is a flow chart of mode set print processing subroutine.

DESCRIPTION OF THE PREFERRED EMBODIMENT

An embodiment of the present invention will now be described below referring to the accompanying drawings.

Figure 1:
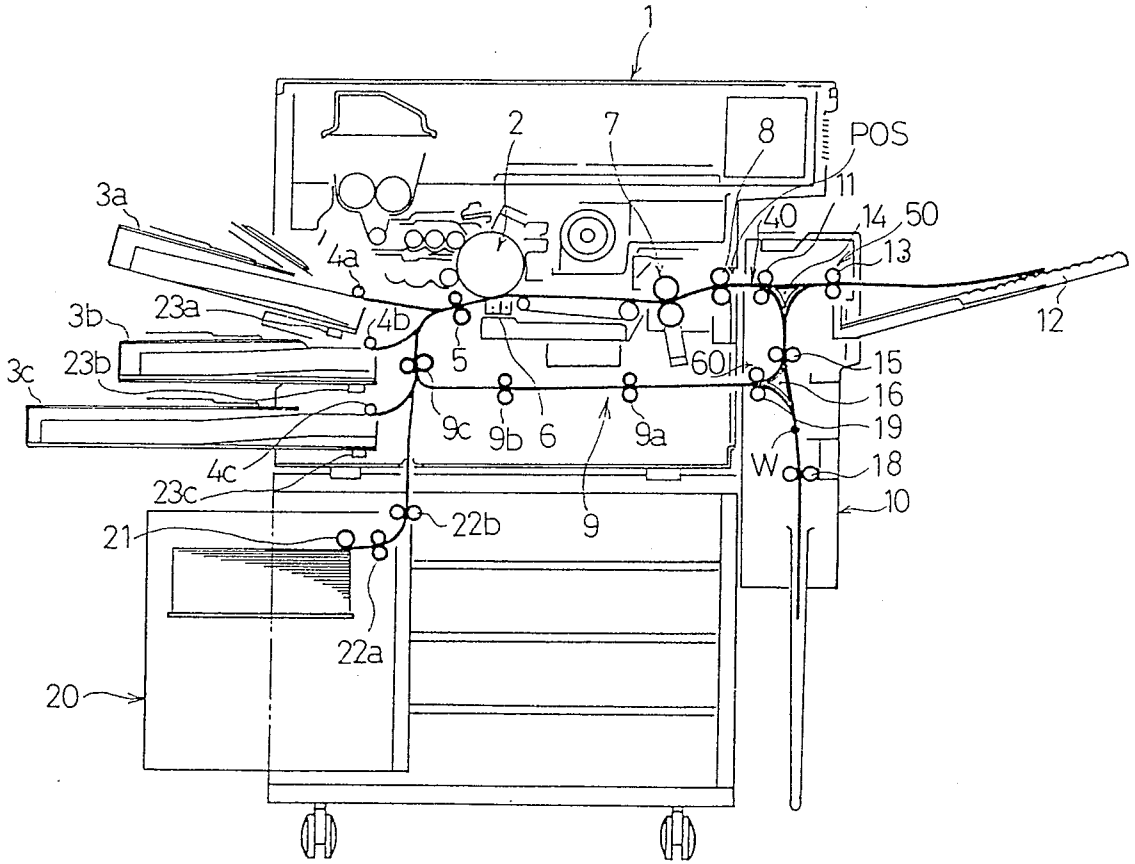
FIG. 1 is a schematic tractional view showing an electrophotographic printing device to which the present invention is applied as an embodiment.

FIG. 1 shows an electrophotographic printing device to which the present invention is applied.

In FIG. 1 the reference numeral 1 represents a main body of a printing device and a well-known electrophotographic image forming section 2 provided with such image forming devices as photoconductive drum, charger, exposure optical system, developing unit, transfer charger and drum cleaner are arranged at about the center of the main body.

The numerals 3*a*,3*b* and 3*c* represent paper feed cassettes mounted on one side of the main body 1 and a paper is fed from a selected paper feed cassette by corresponding pick up roller 4*a*,4*b*,4*c* toward a transfer section 6 arrange between the photoconductive drum and the transfer charger in the image forming section 2 through a register roller 5. An image transferred on the paper at the transfer section 6 is fixed at a fixing section 7 and is then forwarded into a sheet processing unit 10 by a discharge roller 8.

Figure 2:
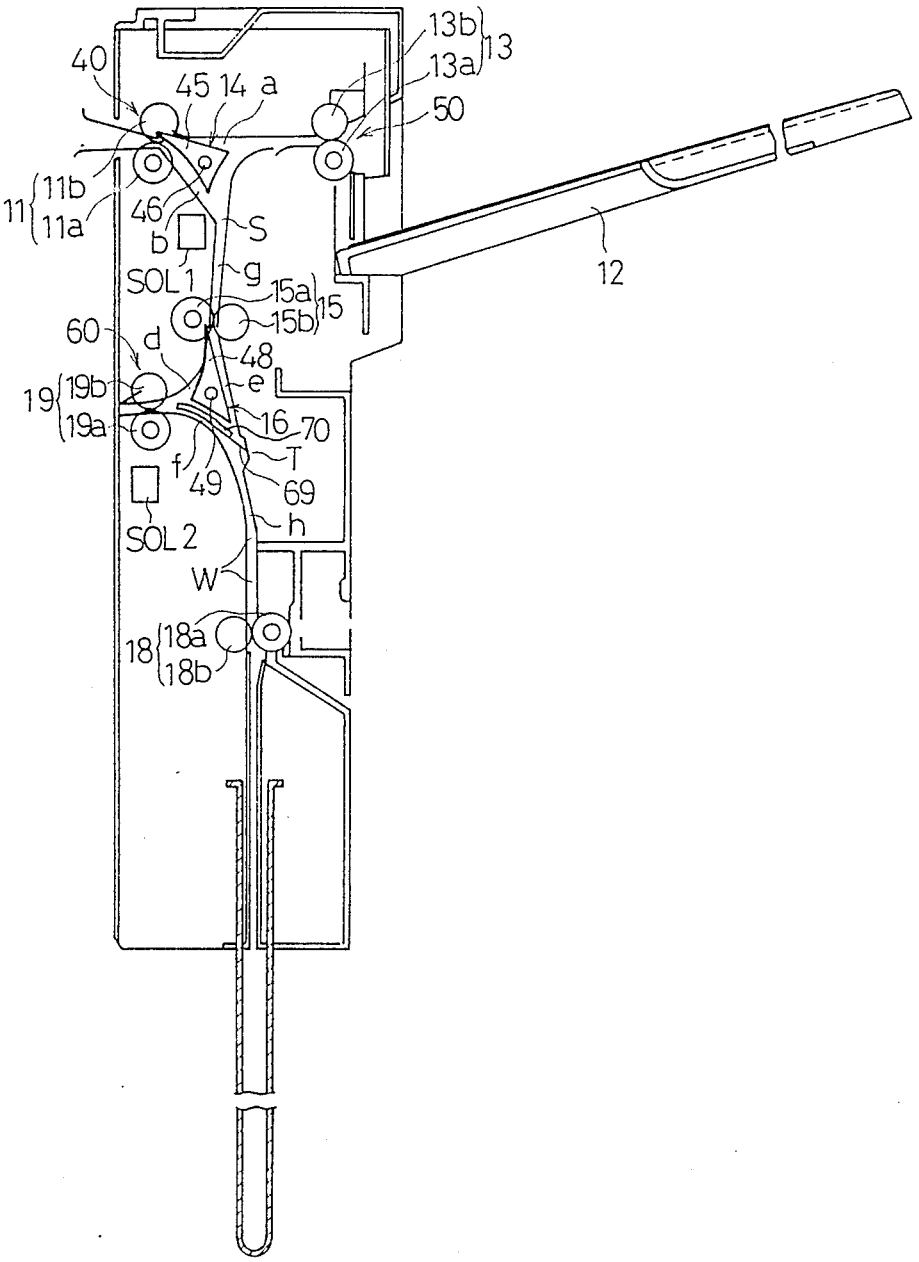
FIG. 2 is an enlarged view of a sheet processing unit which is connected to the printing device.

As illustrated in FIGS. 1 and 2, the sheet processing unit 10 is provided with a sheet intaking section 40 which faces the discharge roller 8 of the main body 1, and a sheet discharging outlet 50 is arranged on the downstream side of the intaking section 40. A sheet returning section 60 is also provided at the lower part of the sheet intaking section 40. The sheet returning section 60 faces the inlet of a sheet re-feeding path 9 provided at the lower part of the main body 1.

The reference numerals 9*a*,9*b* and 9*c* represent transport rollers of the sheet re-feeding path 9 which forward the paper guided to the re-feeding path 9 to the image forming sectiOn 2 again through the register roller 5 thereby enabling a second round of image forming operation by either a both-side mode or a composite mode.

Two paths are connected to the intaking section 40, one of which using a sheet discharging path a which leads a sheet from the intaking section 40 to the sheet discharging outlet 50, and the other being a first sheet re-feeding path b extending downward from the intaking section 40. The path b is further connected to a second re-feeding path a and sheet inverting paths e,h successively, and they are extended downward in series.

To the connecting position of the paths g and e, a path d for composite mode is connected. The path d directly leads a sheet from the lower end of the path g to the sheet returning section 60 for composite process.

To the connecting position T of the paths e and h, a path f for both-side mode is connected. The path f leads a sheet from the upper end of the path h to the sheet returning section 60 in a manner to switch back the sheet.

At the outlet of the intaking section 40, a first transfer device 14 is provided for changeably guiding a sheet from the intaking section 40 to the path a or b. The device 14 is made of a plurality of changeover clicks 45 in triangular shape viewed from a side and attached to a shaft 46, and is driven by a solenoid SOL1 through an unillustrated link mechanism.

When the solenoid SOL1 is turned off, the sheet discharging path a is closed and the first sheet re-feeding path b is opened as shown in FIGS. 1 and 2. When the solenoid SOL1 is turned on, the transfer device is rotatively moved counterclockwise from the position illustrated in FIGS. 1 and 2 to open the path a while the path b is closed.

At the lower end of the path g connected to the path d and the path e, a second transfer device 16 is arranged. The device 16 is made of a plurality of changeover clicks 48 in triangular shape viewed from a side and attached to a shaft 49, and is driven by a solenoid SOL2.

When the solenoid SOL2 is turned off, the path d for composite mode is closed and the third sheet inverting path e is opened. When the solenoid SOL2 is turned on, the transfer device is rotatively moved clockwise from the position illustrated in FIGS. 1 and 2 to open the path d while the path e is closed.

In the path f for both-side mode, a guide 70 is arranged for smoothly guiding a sheet to the returning section 60, and a flexible member 69 formed by polyester film is provided on the guide 70 toward the side walls of the path h. The flexible member 69 is able to bend by the sheet moving from the path e to the path h to permit a pass of the sheet from the path e to the path h, while it functions to guide a sheet being switched back from the path h to the path f.

The sheet intaking section 40 is provided with a transport device 11 comprised of a drive roller 11*a* and a rotative roller 11*b* which is in contact with the drive roller 11*a*, while the sheet discharging outlet 50 is provided with a sheet transport device 13 comprised of a drive roller 13*a* and a rotative roller 13*b* which is in contact with the driver roller 13*a*. The sheet returning section 60 is provided with a sheet transport device 19 comprised of a drive roller 19*a* and a rotative roller 19*b* which is in contact with the drive roller 19*a*.

On the second sheet re-feeding path g, there is provided a first sheet transport device 15 operable both regularly and reversely and comprised of a driver roller 15*a* and a rotative roller 15*b* which is in contact with the driver roller 15*a*. On the fourth sheet inverting path h, there is provided a second sheet transport device operable both regularly and reversely and comprised of a driver roller 18*a* and a rotative roller 18*b* which is in contact with the driver 18*a*. The driver roller 18*a* of the transport device 18 is disposed on the side of the path h opposite to the main body 1.

A return transport force of the driver roller 19*a* in the transport device 19 is set larger than a regular rotative transport force of the driver roller 18*a* in the transport device 18.

The sheet transport speeds of each sheet transport device 11,13,15,18 are all set at a constant value V. In case of both side mode, when the front end of a paper discharged from the discharge roller 8 with its printed surface upside in the main body 1 is detected by a sensor POS, the devices 11,15 and 18 start their regular operation and the paper is forwarded from the sheet intaking section 40 to the paths b,g,e and h. When the rear end of the paper reaches a switch back starting position W in the path h, the transport device 18 is started driving reversely and the paper is guided by the flexible member 9 to be switched back to the path f of both-side mode, and then, the paper is forwarded to the sheet returning section 60 to be supplied to the sheet re-feeding path 9 in the main body 1 by the transport force of the transport device 19 with printed surface kept upside.

After the rear end of a paper has started receiving the return transport force of the transport device 19, if there is a successive paper to follow from the intaking section 10, the transport device 18 starts again its regular operation. Accordingly, the preceding paper and the next paper temporarily pass each other at the position between the drive roller **18*a* and the rotative roller 18*b* in the device 18, however, the preceding paper is returned to the main body 1 as it is since the return transport force of the device 19 is set larger than the regular transport force of the drive roller 18*a*, while the next paper is drawn into the path h by the drive roller 18*a*. Since the transport device 18 is switched over from reverse to regular driving after the rear end of the preceding paper starts receiving the return transport force of the transport device 19, the preceding paper is smoothly forwarded into the main body 1** without having been pulled back.

In both-side mode, when the second surface is supplied for image forming operation after finishing image formation on the first surface, a multiplicity of papers can be successively supplied and stored at minimum intervals which do not affect the time required for switching back. It thus becomes possible to successively perform efficient image forming operations by setting the maximum containable number of sheets as one set corresponding to the conditions required for the image forming operation, wherein the image forming operation on the first surface is successively carried out on each set, and then the second surface image forming operation is successively performed.

In case of composite mode, when the front end of a paper discharged from the discharge roller 8 with its printed surface upside is detected by a sensor POS, the transport devices 11,15 and 19 starts their regular operation, and at the same time, the solenoid SOL2 is turned on in the transfer device 16. Then, the path d for composite mode is opened and a paper proceeds to the sheet returning section 60 from the sheet intaking section 40 passing through the path d, and thereafter, the paper is fed to the sheet re-feeding path 9 of the main body 1 with its printed surface placed downward. In this case, the path h can not be utilized for storing sheets since the switching back of the sheet is not performed. Accordingly, the number of sheets containable under composite mode becomes smaller than the case of both-side mode.

The reference numeral 20 in FIG. 1 represents an optional paper feeding section, 21 a pickup roller and **22*a*,22*b*** transport rollers.

The numerals **23*a*,23*b* and 23*c* are well-known paper size detecting means disposed under the paper feed cassettes 3*a*,3*b* and 3*c***, and for instance, they are comprised of a plurality of micro switches for detecting the size of paper and the direction of the paper being placed, whether it is in the longitudinal or transverse direction. (Refer to U.S. Pat. No. 4,372,676 for example.)

Figure 3:
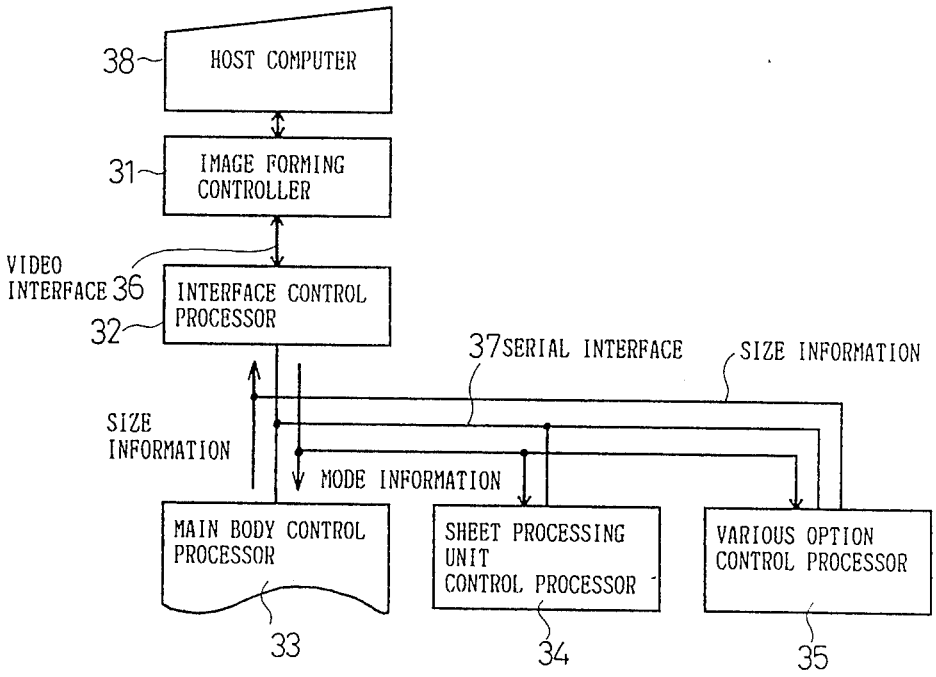
FIG. 3 is a schematic view showing the whole construction of a controlling device of the sheet processing unit.
Figure 4A:
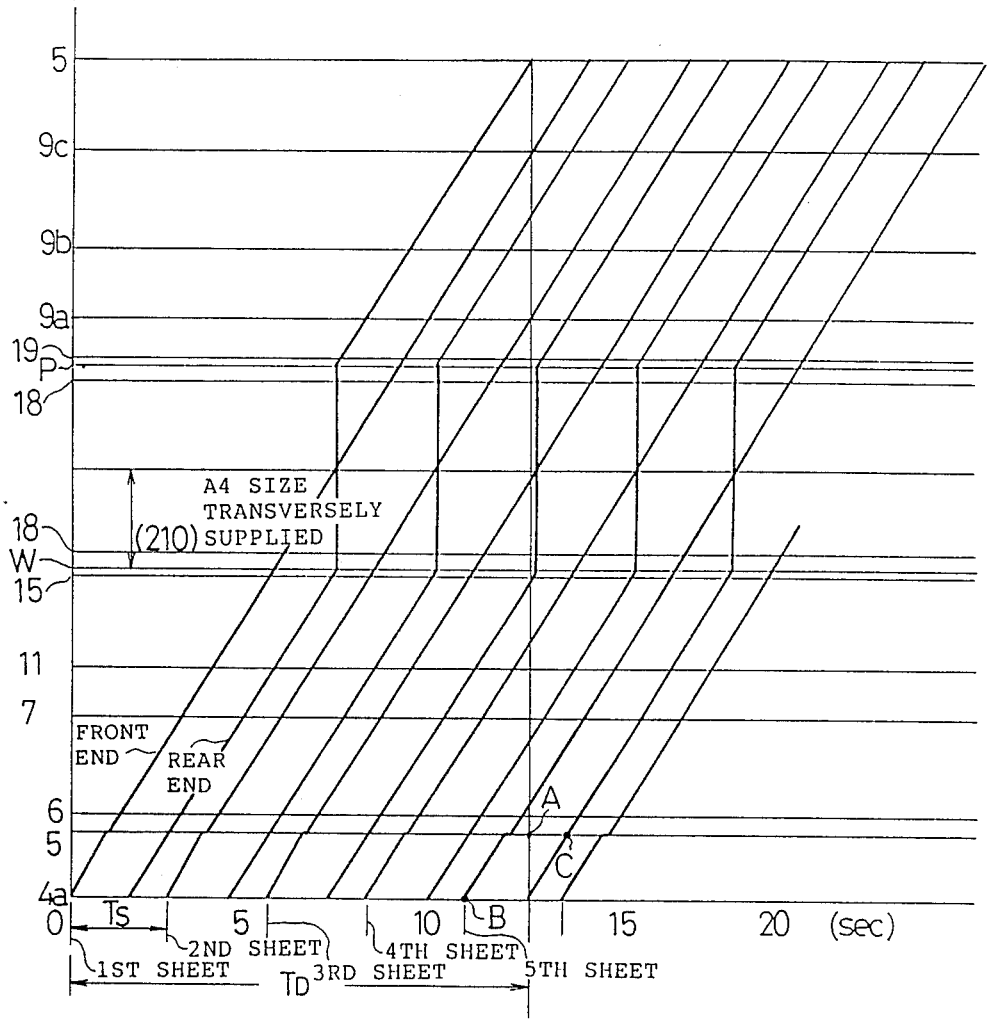
Figure 4B:
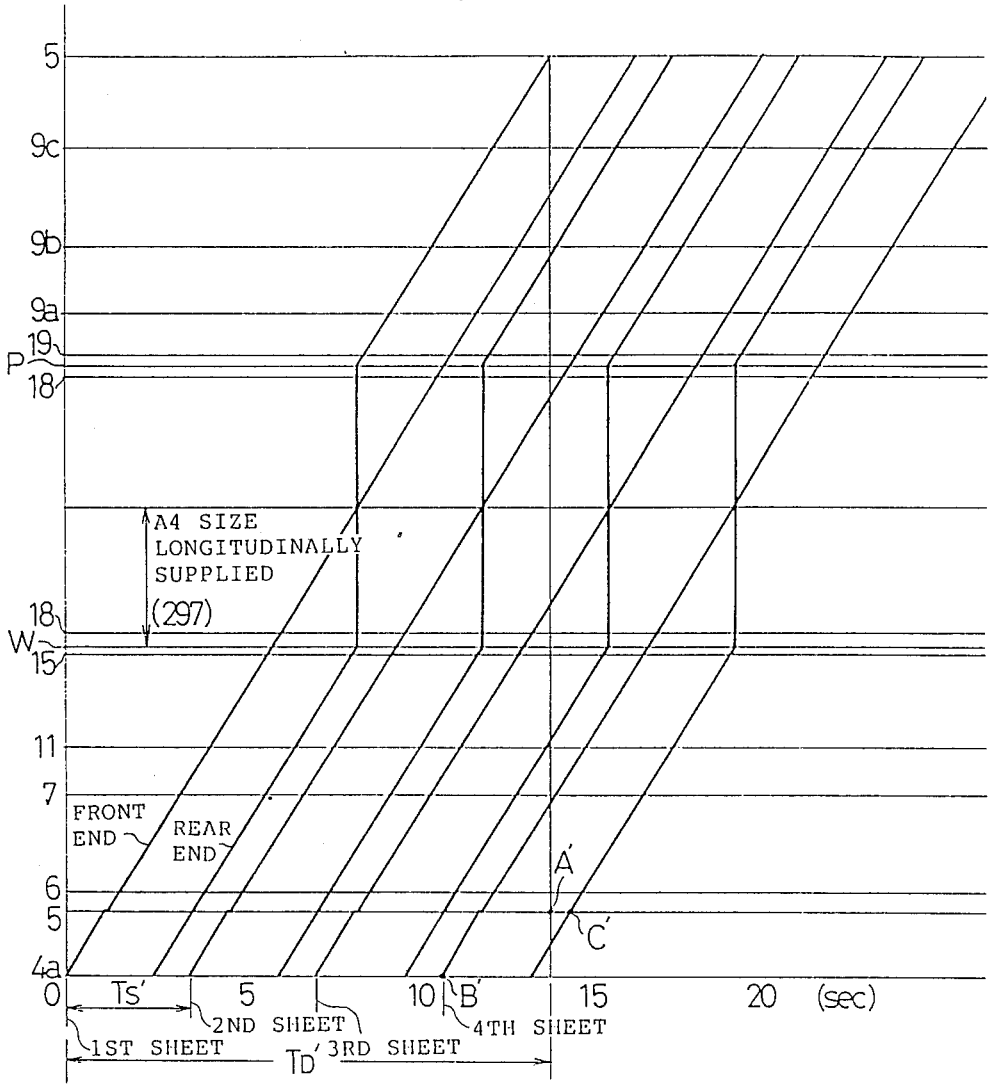
Figure 4C:
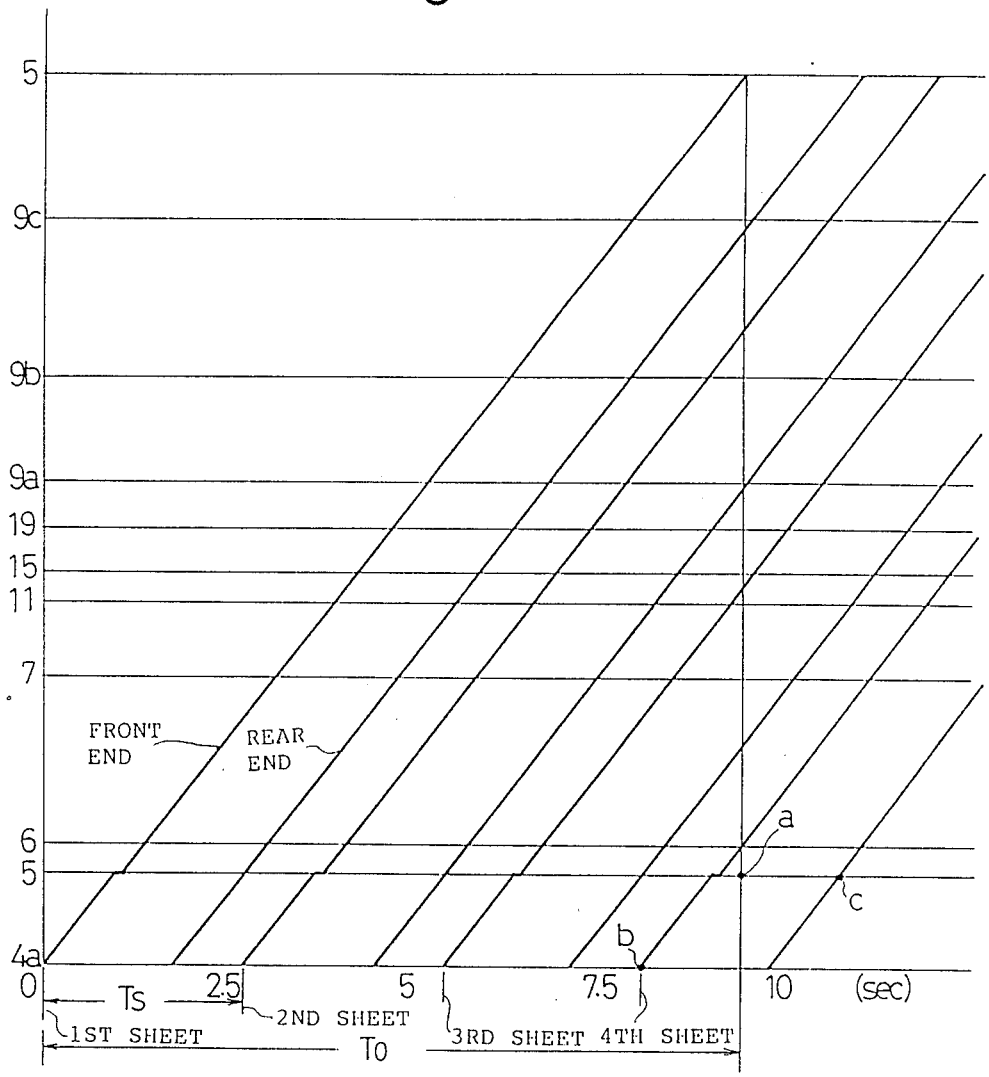
Figure 4D:
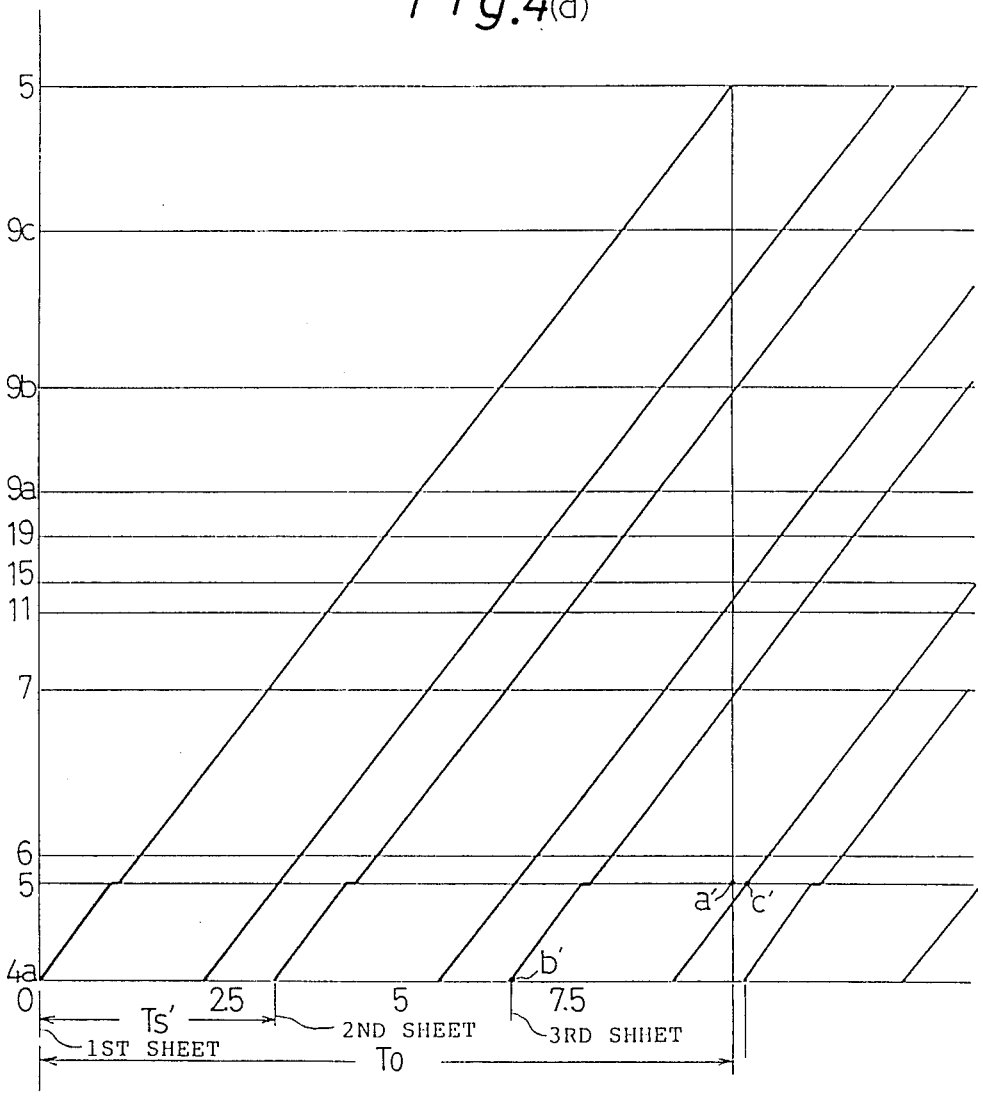

FIG. 3 shows the whole construction of a control device. In FIG. 3, the reference numeral 31 represents an image forming controller, 32 an interface control processor, 33 a control processor of the main body 1, 34 a control processor of the sheet processing unit 10, 35 a control processor for various optional devices including an optional paper feeding section 20.

The image forming controller 31 performs paper size and sheet feeding mode selecting operations based on the data supplied by a host computer 38, and designates the selected mode to the interface control processor 32 through a video interface 36. The interface control processor 32 performs designation to the main body control processor 33, the sheet processing unit control processor 34 and the option control processor 35 through a serial interface 37.

The main body control processor 33 and the option control processor 35 transmit, for instance, the paper size information which is detected by the paper size detecting means **23*a*,23*b* and 23*c* to the image forming controller 31 through the interface control processor 32. The control for the number of sheets to be stored may be carried out by either the image forming controller 31 or the interface control processor 32, however, the interface control processor 32** is used in this embodiment.

Actions of the apparatus will now be described. In an image forming operation under both-side mode, for instance, the paper fed from the paper feed cassette **3*a* on the upper stage of the main body 1 by the pickup roller 4*a* is stopped at a predetermined position by the register roller 5. The paper is then forwarded to the transfer section 6 after having had a timing adjustment and an image formed at the image forming section 2 is transferred onto the paper. After transfer, the paper is further transported to the fixing section 7 for fixing process and thereafter, sent into the sheet processing unit 10 by the discharge roller 8**.

The paper passes through the transport device 11 and is forwarded to the path h which is provided for switch back through the transport device 15 by the first transfer device 14. When the rear end of the paper has reached the inverting point W, the transport device 18 starts reverse rotation and the paper is transported toward the transport device 19 by the second transfer device 16 to be sent out to the paper re-feeding path 9 in the main body 1.

The paper is forwarded to the register roller 5 again passing through the paper re-feeding path 9 and sent to the transfer section 6 after having had a timing adjustment. At this stage, a second image formed on the second surface of the paper at the image forming section 2 is transferred onto the reverse side of the paper and is fixed at the fixing section 7, and thereafter, discharged onto the discharge tray 12 passing through the discharge roller 8, the transport device 11, the first transfer device 14 and the transport device 13.

In an image forming operation under composite mode, an image formed at the image forming section 2 as described above is transferred onto the front surface of the paper at the transfer section 6 and fixed at the fixing section 7. Then, the paper is forwarded to the sheet processing unit 10 through the discharge roller 8 and is transported to the paper re-feeding path 9 passing through the transport device 11, the first transfer device 14, the transport device 15, the second transfer device 16 and the transport device 19.

Thereafter, the paper is sent to the transfer section 6 again through the register roller 5, and the second image formed at the image forming section 2 is again transferred onto the surface of the paper and is fixed at the fixing section 7. The paper is then discharged onto the discharge tray 12 passing through the sheet processing unit 10.

In the above description, an image formation is made onto a sheet of paper, however, when an image formation is made under the above-mentioned mode onto a plurality of sheets of paper, it may be arranged to carry out the image forming operation by holding a plurality of sheets in the circular sheet path extending from a register roller 5 back to the register roller 5 passing through the paper re-feeding path 9 so that high throughput can be attained Furthermore, even higher throughput may be attained if the number of sheets to be held in the circular path is more increased.

The maximum containable number of sheets are determined by a correlation between a time interval $T_S$ of each paper feed and the time $T_D$ required for the paper fed from the paper feed roller 4a to return to the register roller 5 traveling through the sheet processing unit 10 and the paper re-feeding path 9.

In this embodiment, the paper transport speed is specially set constant at all times so that the maximum containable number of sheets are determined by the interval between the front ends of each sheet and by the substantial length of transport path in which the paper fed is returned to the register roller 5 after passing through the paper re-feeding path 9.

Now, the containable number of sheets under both-side mode when A4 sheet is fed longitudinally and transversely will be described referring to the time charts shown in FIGS. 4(*a*) and 4(*b*).

In this embodiment, the driving action of the pickup rollers 4a,4b,4c and the register roller 5 are controlled to make the interval between each sheet of paper constant whether the paper is placed longitudinally or transversely so that the distance between the front ends of each sheet, i.e. a paper feed interval, is changed corresponding to the length of paper in the direction of transport.

In FIG. 4(*a*), when A4 sheet is fed transversely, a first sheet is returned to the register roller 5 at point A, which is $T_D$ time (12460 msec) after the sheet is fed.

On the other hand, within the time up to the point A, a paper feed time point B is included for the fifth sheet as long as the paper feed time interval is $T_S$ (2720 msec). However, the maximum number of sheets present in the transport path is four because the time C at which the trailing edge of the fifth sheet passes the register roller 5 is beyond the point A.

Similarly, in FIG. 4(*b*), when A4 sheet is fed longitudinally, a first sheet is returned to the register roller 5 at point A', which is $T_D'$ time (13140 msec) after the sheet is fed. Within the time up to the point A', a paper feed time point B' is included for the fourth sheet as long as the paper feed time interval is $T_S'$ (3410 msec). However, the maximum number of sheets present in the transport path is three because the time C' at which the trailing edge of the fourth sheet passes the register roller 5 is beyond the point A'.

The containable number of sheets under composite mode when A4 sheet is fed either longitudinally or transversely will now be described referring to the time charts shown in FIGS. 4(*c*) and 4(*d*). As illustrated in FIGS. 4(*c*) and 4(*d*). when A4 sheets are fed transversely and longitudinally, each of the first sheets is returned to the register roller 5 at points a and a', which is $T_O$ time (9660 msec) after the sheets are fed.

When the sheet is fed transversely, within the time up to the point a, a paper feed time point b is included for the fourth sheet as long as the paper feed time interval is $T_S$ On the other hand, when the sheet is fed longitudinally, within the time up to the point a', a paper feed time point b' is included for the third sheet as long as the paper feed time interval is $T_S$ However, the time c at which the trailing edge of the fourth sheet fed transversely passes the register roller 5 is beyond the point a, the maximum number of sheet present in the transport path is three. For the similar reason, the number of sheets are two for the case where the paper is fed longitudinally.

Control actions for controlling the containable number of sheets corresponding to the image forming mode and the size of paper will now be described with reference to FIGS. 5 through 8.

Prior to entering into descriptions of the flow charts, the term 'on edge' will be defined as follows. The term 'on edge' means a change in the condition when the condition of switch, sensor, signal or the like is changed from off condition to on condition.

To begin with, in the main flow shown in FIG. 5, an initialization in an interface control processor 32 is performed (step #1), and then communication is conducted between an image forming controller 31 with a video interface 36 (step #2). Practically, various modes are primarily set and print requirement and the like are also checked.

Print requirement from the image forming controller 31 is checked (step #3). and if there is a requirement, a print control is carried out (step #4). Further, data output to a serial interface 37 (print designation and mode set), and input (information of the main body 1 and information of the sheet processing unit 10) are processed (step #5), and thereafter. The program is returned to step #2 to form a series of loops.

In the print control, as shown in FIGS. 6(*a*) and 6(*b*), if there is an on edge of print requirement signal (step #10) a check is first made whether it is for both-side mode or composite mode (step #11, 12).

Since the control for containable number of sheets is conducted almost in the same manner for both-side mode and composite mode, description will be made in parallel. The step numbers in square brackets [ ] shows the case of composite mode.

Judgment is first made whether it is for both-side mode or composite mode (step #11) [step #12]. and if the answer is yes, judgment is made whether flag B,D is set (step #23) [step #15]. The flags B and D mean that the containable number of sheets have reached the maximum limit in each mode, and they are set at steps #30 and #22 respectively. In case when flags B and D are set, a warning for excess number of sheets is output to the video interface side (step #31), and judgment is made whether flag E is set or not (step #32).

The flag E is provided for changing over a sheet from a first image formation to a second image formation under both-side mode or composite mode, and if it is not set, the set is made at this stage (step #33). and at the same time, paper feed safety timer T for a second image formation is started (step #34). Then, 1 is subtracted from a print counter to be mentioned later to proceed for counting down thereafter. When the print counter shows 0, it means that the second image forming operation has finished so that flags A,B,C,D are forcibly reset to an ordinary mode (steps #35 through #37).

When the flag B,D is not set judgment is then made whether flag A,C is set or not (step #24) [step #16]. This judgment is made for whether successive print designation is occurred or not under the same mode, and judgment is made No at a first sheet print designation, and flag A,C is set (step #25) [step #17], and then proceed to a subroutine for setting size count in the both-side mode or composite mode (step #26) [step #18]. Thereafter, the print counter is set at 1 (step #27) [step #19), and if flag E is not reset. With a judgment that a second round of image formation has been changed to a first round of image formation, the flat E is reset for enabling a first round of image forming operation on a new sheet and at the same time the paper feed safety timer T is started [step #13*a* through #13*c*], and then mode set and print designation are conducted (step #14), and thereafter, the program is returned.

The procedure for print designation under both-side mode or composite mode for a first sheet is conducted in the manner as described above. and in case when print designation under the same mode has successively occured, the judgment at the steps #24 and #16 becOmes Yes. Then, 1 is added to the print counter (step #28) [step #20], and comparison is made between the size counter set at step #26, #18 (step #29) [step #21). In case when it has not reached the maximum number of sheets, the program is returned through step #14, and if it has reached the maximum number of sheets. flag B,D is set (step #30) step #2, and further print designation under the same mode is prohibited, and then the program is returned through steps #13*a* through 14. These flags B and D are judged at steps #23 and #15 as described above. If judgment is made neither both-side mode nor composite mode at steps #11 and #12. a series of flags A,B,C,D are reset (step #13) and the program is returned through step #14.

In the size count subroutine under both-side mode and composite mode, as shown in FIGS. 7(*a*) and 7(*b*), the sizes of paper supplied are checked (step #41) step #5 and judgment is made whether A4 size sheet is fed transversely or longitudinally step #42) step #5, and then size counters are set based on the maximum number of sheets corresponding to the judgments (step #43, 44) (step #53, 54).

In the mode set print designation subroutine, as shown in FIG. 8, judgment is made whether flag E is reset or not only when there is an on edge of the print requirement signal, and when it is reset, it means that print is required for a first time on a new sheet of paper and therefore, a paper is fed from a selected cassette (steps #61 through #63), and then the program proceeds to step #64. If there is not an on edge of the requirement signal, the program proceeds to step #64 as it is.

At step #64, when judgment is made that the paper feed safety timer T is finished, the program proceeds to step #65. As described in FIGS. 6(*a*) and 6(*b*), the paper feed safety timer T is started when flag E is set or reset, wherein a safety time is measured for properly changing over the paper feed mode at the sheet processing unit 10 corresponding to a practical condition of paper transport. Practically, a little shorter time is set than the time required for a paper which is fed upon the print requirement signal is emitted reaches the transfer device 14.

At step #65, judgment is made whether it is an ordinary mode or not, and when it is an ordinary mode, the solenoid SOL1 is turned off and mode is set on the transfer device 14 to lead a paper introduced into the paper processing unit 10 to the discharge tray 12, and thereafter, print designation process is conducted (step #67).

If it is not an ordinary mode at step #65, the program proceeds to step #68. If flag E is not reset at this stage, it means that a second round of image forming operation has been carried out and the solenoid SOL1 is turned off (step #74), and a mode is set on the transfer device 14 to lead the paper after image formation to the discharge tray 12.

At step #68, when flag E is set, it means that the first round of image formation is performed, and if it is under composite mode, the solenoid SOL1 is turned on, and by turning on the solenoid SOL2 (step #69 through #71), mode is set on the transfer devices 14,16 to lead the paper after image formation to the paper re-feeding path 9 through the paths b,g and d.

At step #69, if it is both-side mode, the solenoid SOL1 is turned on, and by turning off the solenoid SOL2 (steps #72,#73), mode is set on the transfer devices 14,16 to lead the paper after image formation to the paper re-feeding path 9 through the paths b,g,e,h and f after it is switched back.

In order to simply describe the above embodiment, an example is shown only when A4 size paper is fed transversely and longitudinally, however, it is obvious that a multiplicity of sizes of paper can be selectively used. When the printing device is controlled for carrying out composite image forming operation on both sides of paper, the present invention may also be applied by setting a proper containable number of sheets corresponding to each condition so as to accomplish higher throughput.

In this embodiment, when both-side mode is performed, it is arranged that two sheets of paper pass each other in the path h of the sheet processing unit 10, however, it may be arranged to have another sheet of paper enter into the path h after the rear end of a paper has passed the inverting point W. It is, however, necessary in this case to control paper feed timing to make the distance between each sheet of paper wider than the case of composite mode in order not to have papers overlapped at the inverting point W. In this case, the containable number of sheets are also properly set by correlative relation between the substantial length of sheet transport path and the distance of the front ends of each sheet, however, the containable number of sheets under both-side mode will be set less than that of the case of composite mode.

Although the present invention has been fully described by way of examples with reference to the accompanying drawings, it is to be noted that various changes and modifications will be apparent to those skilled in the art. Therefore, unless otherwise such changes and modifications depart from the scope of the present invention, they should be construed as being included therein.

I claim:

1. An image forming apparatus, comprising:

an image forming means for forming images on a sheet being transported;

a sheet feeding means for feeding a sheet one by one;

a sheet transporting means for transporting a sheet being fed by the sheet feeding means for image formation, which includes a sheet re-feeding path capable of transporting the sheet to the image forming means against for further image formation by successively receiving the sheet which completed an image forming operation;

a first transport path switching means for selectively guiding a sheet after image formation either to the sheet re-feeding path or to the outside of the apparatus;

a sheet turning over means provided in the sheet re-feeding path for turning over the sheet being refed;

an image forming mode selecting means for selecting either a composite image forming mode in which plural numbers of image forming operations are performed on the same surface of the sheet or a both-surface image forming mode wherein image forming operations are carried out on both surfaces of the sheet;

a second transport path switching means for selectively guiding a sheet being directed to the sheet re-feeding path to pass through the sheet turning over means or not therethrough in accordance with the mode selected; and a controlling means for controlling the maximum number of sheets present in said sheet transporting means simultaneously in accordance with the mode selected by said image forming selecting means.

2. The image forming apparatus as defined in claim 1, further comprising:

a sheet feed prohibiting means for temporarily prohibiting paper feed after the maximum number of sheets are successively fed from the sheet feeding means until image forming process is finished under the mode selected for the sheets.

3. The image forming apparatus as defined in claim 2, further comprising a transport path switching control means for controlling the first transport path switching means so as to guide the sheets of the maximum number successively to the sheet re-feeding path and to subsequently discharge them to the outside of the apparatus.

4. The image forming apparatus as defined in claim 1, wherein the sheet turning over means includes a switchback roller which is rotatable in both regular and reverse directions.

5. The image forming apparatus as defined in claim 4, wherein the sheet turning over means includes a driven roller which is driven in contact with the switchback roller.

6. The image forming apparatus as defined in claim 5, wherein the controlling means causes the maximum number of sheets under the both-surface image forming mode to be more than the case under the composite image forming mode.

7. An image forming apparatus, comprising:

a sheet feeding means for feeding a sheet one by one;

an image forming means for forming images on the sheet being fed by the sheet feeding means;

a sheet discharging means for discharging a sheet which completed an image forming process to the outside of the apparatus;

a sheet re-feeding means for feeding a sheet after image formation again to the image forming means, which includes a first and second sheet re-feeding transport paths substantially different from each other in length and a first transport path switching means for selectively guiding the sheet after image formation either to the first or to the second sheet re-feeding path;

a second transport path switching means for selectively switching over the transport path for guiding the sheet after image formation either to the sheet discharging means or to the sheet re-feeding means;

a sheet re-feeding transport path selecting means for selecting either one of the first or second sheet re-feeding transport path;

a sheet re-feeding transport switching control means for controlling the first transport path switching means corresponding to the selection made by the sheet re-feeding transport path selecting means; and a controlling means for controlling the maximum number of sheets present in a sheet transport path which extends from the sheet feeding means to the sheet discharging means and which includes the sheet re-feeding means in accordance with the selection made by the sheet re-feeding transport path selecting means.

8. The image forming apparatus as defined in claim 7, further comprising a sheet feeding control means for controlling the sheet feeding means and the sheet re-feeding means so as to feed the maximum number of sheets from the sheet re-feeding means to the image forming means after the maximum number of sheets are successively fed to the image forming means by the sheet feeding means.

9. The image forming apparatus as defined in claim 7, wherein the first sheet re-feeding transport path leads a sheet after image formation to the image forming means without turning it over, while the second sheet re-feeding means directs a sheet after image formation to the image forming means after the sheet is turned over.

10. The image forming apparatus as defined in claim 8, further comprising a pair of rollers provided in the second sheet re-feeding path comprises of a switchback roller which is driven in both regular and reverse directions and a driven roller which is driven in contact with the switchback, roller.

11. The image forming apparatus as defined in claim 7, further comprising a transport path switching control means for controlling the second transport path switching means so as to guide the sheets of the maximum number successively to the sheet re-feeding means and to subsequently guide them to the sheet discharging means.

12. An image forming apparatus, comprising:

an image forming means for forming images on a sheet being fed;

a sheet feeding means for feeding a sheet to the image forming means;

a sheet re-feeding means for feeding a sheet which completed image formation to the image forming means again, which includes a first transport means for transporting a sheet after image formation to the image forming means without turning it over and a second transport means for transporting a sheet after image formation to the image forming means after the sheet is turned over;

a transport path selecting means for selecting either one of the first or second transport means;

a transport switching means for selectively guiding a sheet after image formation to either the first or the second transport means selected; and a controlling means for varying the maximum number of sheets present in said sheet re-feeding means simultaneously in accordance with the selection made by the transports path selecting means.

13. An image forming apparatus provided with composite image forming mode and both-surface image forming mode, comprising:

an image forming means for forming images on a sheet being transported;

a sheet transport path for transporting a sheet after image formation to the image forming means again; and a containable number of sheets control means for varying the maximum number of sheets to be held in the sheet transport path under composite image forming mode and under both-surface image forming mode.

14. The image forming apparatus as defined in claim 13, further comprising a sheet turning over means provided midway on the sheet transport path for turning over a sheet being transported to the image forming means again.

15. An image forming apparatus, comprising:

a sheet feeding means for forwarding a sheet one by one;

a sheet transporting means for transporting a sheet being transported from the sheet feeding means;

a composite image forming means for performing plural number of image forming operations on the same surface of a sheet being transported;

a both-surface image forming means for forming images on both surfaces of a sheet being transported;

an image forming mode selecting means for selectively actuating either one of the composite image forming means or the both-surface image forming means; and a containable number of sheets controlling means for varying the maximum number of sheets to be held in the sheet transporting means corresponding to the selection made of either the composite or the both-surface image forming means.

16. The image forming apparatus as defined in claim 15, wherein the both-surface image forming means includes a means for turning over a sheet.

17. The image forming apparatus as defined in claim 15, further comprising a sheet feed prohibiting means for prohibiting sheet feed from the sheet feeding means when the sheet in the sheet transporting means reaches the maximum number of sheets until image forming process is finished under a predetermined mode.

18. An image forming apparatus in which image forming operations are performed a plurality of times for each sheet on every set of sheets of a predetermined number, comprising:

a composite image forming means for forming images two times on the same surface of a sheet;

a both-surface image forming means for forming images on both surfaces of a sheet;

an image forming mode selecting means for selectively actuating either one of the composite or the both-surface image forming means; and a containable number of sheets controlling means for varying the predetermined number of sheets corresponding to the selection made for either the composite or the both-surface image forming means.

19. An image forming apparatus in which image forming operations are performed a plurality of times for each sheet at every set of sheets of a predetermined number, comprising:

an image forming means for forming images on a sheet being transported;

a sheet feeding means for feeding a sheet one by one;

a sheet transporting means for transporting a sheet being transported from the sheet feeding means, which includes a sheet re-feeding transport path for guiding a sheet which completed a first round of image formation to the image forming means again;

a sheet discharging means for discharging a sheet after image formation to the outside of the apparatus;

an image forming mode selecting means for selecting one of a plurality of image forming modes substantially different in the effective length of transport path;

a judging means for judging the maximum number of sheets which could be present in the sheet transport path corresponding to the selection of the image forming mode; and a number of containable sheets varying means for varying the predetermined number of sheets corresponding to the result of the judgement made by the judging means.

20. An image forming apparatus as defined in claim 19, further comprising a sheet feed controlling means wherein the sheet feed from the sheet feeding means is prohibited after a predetermined number of sheets are successively fed from the sheet feeding means, and after the predetermined number of sheets are fed to the image forming means from the sheet re-feeding transport path, sheet feeding from the sheet feeding means is started again.

21. An image forming apparatus as defined in claim 19, further comprising:

a transport path switching means for selectively guiding a sheet after image formation either to the discharging means or to the sheet re-feeding transport path; and a transport path switching control means for controlling the transport path switching means so as to switch over sheet transporting direction for each predetermined number of sheets.

22. An image forming apparatus in which image forming operations are performed a plurality of items for each sheet of every set of sheets of a predetermined number, comprising:

an image forming means for forming images on a sheet being transported;

a sheet feeding means for forwarding a sheet one by one;

a sheet transport path for transporting a sheet being forwarded for the sheet feeding means, which includes a sheet-re-feeding transport path for directing a sheet which finished a first round of image formation to the image forming means again;

a sheet discharging means for discharging a sheet after image formation to the outside of the apparatus;

a judging means for judging the maximum number of sheets which could be present in the sheet transport path based on the distance from the front end of a sheet being transported to the front end of a sheet followed; and a changing means of containable number of sheets for changing the predetermined number of sheets 23. The image forming apparatus as defined in claim 22, further comprising a sheet feed controlling means wherein the sheet fed from the sheet feeding means is prohibited after a predetermined number of sheets are successively fed from the sheet feeding means, and after the predetermined number of sheets are fed to the image forming means again from the sheet re-feeding transport path, sheet feeding from the sheet feeding means is started again.

24. The image forming apparatus as defined in claim 23, further comprising:

a transport path switching means for selectively guiding a sheet after image formation either to the discharging means or the to sheet re-feeding transport path; and a transport path switching control means for controlling the transport path switching means so as to switch over the sheet transporting direction for each predetermined number of sheets.

25. An image forming apparatus for performing two rounds of image forming operations for each sheet, wherein a plurality of sheets are divided into sets consisting of a predetermined number of sheets, and after a first round of image forming operation is successively performed on a set of all the predetermined number of sheets, a second round of image forming operation is carried out for all sheets of the set and such action is repeatedly conducted on each set of the predetermined number of sheets, comprising:

an image forming means for forming images on a sheet being transported;

a sheet feeding means for forwarding a sheet one by one;

a sheet transport path for transporting a sheet being forwarded from the sheet feeding means, which includes a sheet re-feeding transport path for directing a sheet which finished a first round of image formation to the image forming means again;

a sheet discharging means for discharging a sheet after image formation to the outside of the apparatus;

a detecting means for detecting the length of a sheet being transported; and a changing means of containable number of sheets for changing the predetermined number of sheets corresponding to the length of a sheet detected by the detecting means.

26. The image forming apparatus as defined in claim 25, further comprising a sheet feed controlling means wherein the sheet fed from the sheet feeding means is prohibited after a predetermined number of sheets are successively fed from the sheet feeding means, and after the predetermined number of sheets are fed to the image forming means again from the sheet re-feeding transport path, sheet feeding from the sheet feeding means is started again.

27. The image forming apparatus as defined in claim 26, further comprising:

a transporter path switching means for selectively guiding a sheet after image formation either to the discharging means or to the sheet re-feeding transport path; and a transport path switching control means for controlling the transport path switching means so as to switch over the sheet transporting direction for each predetermined number of sheets.

28. The image forming apparatus as defined in claim 27, wherein the detecting means includes a designating means for designating the length of a sheet to be fed, and the sheet feeding means forwards the kind of sheet designated by the designating means from a plurality of kinds of sheets having different length.

29. An image forming apparatus for performing two rounds of image forming operations for each sheet, wherein a plurality of sheets are divided into sets consisting of a predetermined number of sheets, and after a first round of image forming operation is successively performed on a set of all the predetermined number of sheets, a second round of image forming operation is carried out for all sheets of the set and such action is repeatedly conducted on each set of the predetermined number of sheets, comprising:

an image forming means for forming images on a sheet being transported;

a sheet feeding means for forwarding a sheet one by one;

a sheet transport path for transporting a sheet being forwarded from the sheet feeding means, which includes a sheet re-feeding transport path for directing a sheet which finished a first round of image formation to the image forming means again;

a sheet discharging means for discharging a sheet after image formation to the outside of the apparatus;

an image forming mode selecting means for selecting one of a plurality of image forming modes of substantially different length of the sheet transport path;

a judging means for judging the maximum number of sheets which could be present in the sheet transport path based on the image forming mode selection and the distance between the front end of a sheet and the front end of a sheet followed; and a changing means of containable number of sheets for changing the predetermined number of sheets corresponding to the result of the judgement made by the judging means for containable number of sheets.

30. The image forming apparatus as defined in claim 29, further comprising a sheet feed controlling means wherein the sheet feed from the sheet feeding means is prohibited after a predetermined number of sheets are successively fed from the sheet feeding means, and after the predetermined number of sheets are fed to the image forming means against from the sheet re-feeding transport path, sheet feeding from the sheet feeding means is started again.

31. The image forming apparatus as defined in claim 30, further comprising:

a transport path switching means for selectively guiding a sheet after image formation either to the discharging means or to the sheet re-feeding transport path; and a transport path switching control means for controlling the transport path switching means so as to switch over the sheet transporting direction for each predetermined number of sheets.

32. An image forming apparatus, comprising:

a sheet feeding means of forwarding a sheet one by one;

a sheet transporting means for transporting the sheet being forwarded from the sheet feeding means;

an image forming means for forming images on the sheet being transported in as sheet transport path;

a sheet discharging means for discharging the sheet after image formation to the outside of the apparatus;

an image forming mode selecting means for selecting a plurality of image forming modes, each having different capacity of containable maximum number of sheets in the sheet transport path; and a controlling means for controlling the sheet feeding means so as to vary the maximum number of sheets present in the sheet transport path simultaneously in accordance with the selection made by the image forming mode selecting means;

33. An image forming apparatus in which image forming operations are performed a plurality of times of each sheet of every set of sheets of a predetermined number, comprising:

an image forming means for forming images on a sheet being transported;

a sheet feeding means of forwarding a sheet one by one;

a sheet transport path for transporting a sheet being forwarded from the sheet feeding means, which includes a sheet re-feeding transport path for directing a sheet which finished a first round of image formation to the image forming means again;

a sheet discharging means for discharging a sheet after image formation to the outside of the apparatus; and a containable number of sheets controlling means for varying the predetermined number of sheets based on the time required for a sheet to make a round in the sheet transport path and the time interval of sheet feeding.

34. The image forming apparatus as defined in claim 33, further comprising a sheet feed controlling means wherein the sheet feed from the sheet feeding means is prohibited after a predetermined number of sheets are successively fed from the sheet feeding means. and after the predetermined number of sheets are fed to the image forming means again from the sheet re-feeding transport path, sheet feeding from the sheet feeding means is started again.

35. The image forming apparatus as defined in claim 34, further comprising:

a transport path switching means for selectively guiding a sheet after image formation either to the discharging means or to the sheet re-feeding transport path; and a transport path switching control means for controlling the transport path switching means so as to switch over the sheet transporting direction for each predetermined number of sheets.

36. The image forming apparatus as defined in claim 34, further comprising:

a detecting means for detecting the length of a sheet to be transported; and a sheet feed controlling means for controlling the sheet feeding means so as to change the time interval of a sheet feeding based on the length of a sheet detected by the detecting means.

37. The image forming apparatus as defined in claim 34, wherein the image forming apparatus is capable of operating under a plurality of image forming modes wherein the time required for a sheet to make a round in the sheet transport path is different for each mode, and is provided with a selecting means for selecting one of the plurality of image forming modes, and the containable number of sheets controlling means changes a predetermined number of sheets correlatively with the image forming mode selection by the selecting means.

38. A method of forming images in an image forming apparatus wherein a plurality of sheets are divided into sets consisting of a predetermined number of sheets and after a first round of image forming operation is successively carried out on all the predetermined number of sheets of a set, a second round of image forming operation is performed on the set thus making two rounds of image forming operations on a sheet of paper, the image forming apparatus being capable of operating under a plurality of image forming modes having a different sheet transport path respectively, provided with a selecting means for selecting one of the plurality of image forming modes, an image forming means for forming images on a sheet, a sheet transporting means for transporting a sheet to the image forming means for a first round of image formation and a sheet transport path for guiding a sheet which finished the first round of image formation to the image forming means for a second round of image forming operation, comprising the steps of:

(A) selectively setting the predetermined number of sheets based on the image forming mode selected by the selecting means;

(B) carrying out the first round of image forming operation by feeding the predetermined number of sheets of a set to the image forming means;

(C) performing the second round of imaging forming operation by directing the predetermined number of sheets which finished the first round of image formation to the sheet transport path; and (D) repeating the above-mentioned steps B and C.

* * * * *

UNITED STATES PATENT AND TRADEMARK OFFICE

CERTIFICATE OF CORRECTION

PATENT NO. : 4,943,832

DATED : July 24, 1990

INVENTOR(S) : Kiyoshi Emori

It is certified that error appears in the above-identified patent and that said Letters Patent is hereby corrected as shown below:

In col. 1, line 29, change "fOrming" to --forming--.

In col. 1, line 48, change "spaced" to --speed--.

In col. 2, line 15, change "lo s" to --loss--.

In col. 2, line 40, change "provides" to --provided--.

In col. 3, line 1, change "BRIEF OF THE DRAWINGS" to --BRIEF DESCRIPTION OF THE DRAWINGS--.

In col. 3, line 3, change "tractional" to --constructional--.

In col. 3, line 15, after "FIG. 7(a)", insert --and--.

In col. 3, line 15, delete "," (comma).

In col. 3, line 28, after "FIG. 1", insert "," (comma).

In col. 3, line 39, change "arrange" to --arranged--.

In col. 3, line 57, change "sectiOn" to --section--.

In col. 3, line 62, change "using" to --being--.

In col. 3, line 67, change "a" to --g--.

UNITED STATES PATENT AND TRADEMARK OFFICE

CERTIFICATE OF CORRECTION

PATENT NO. : 4,943,832

DATED : July 24, 1990

INVENTOR(S) : Kiyoshi Emori

It is certified that error appears in the above-identified patent and that said Letters Patent is hereby corrected as shown below:

In col. 5, line 3, change "both side" to --both-side--.

In col. 5, line 53, change "starts to --start--.

In col. 7, line 23, after "attained", insert --.-- (period).

In col. 8, line 14, after "Ts", insert --.-- (period).

In col. 8, line 17, after "Ts", insert --.-- (period).

In col. 8, line 46, change ". The" to --, the--.

In col. 8, line 51, change "step" to --steps--.

In col. 8, line 58, change "." (period) to --,-- (comma).

In col. 9, line 10, after "set", insert --,-- (comma).

In col. 9, line 19, after "#19", change ")" (parenthesis) to --]-- (bracket).

In col. 9, line 19, change ". With" to --, with--.

In col. 9, line 24, change "[step #13a through #13c] to --(step #13a through #13c)--.

In col. 9, line 29, change "." (period) to --,-- (comma).

UNITED STATES PATENT AND TRADEMARK OFFICE

CERTIFICATE OF CORRECTION

PATENT NO. : 4,943,832

DATED : July 24, 1990

INVENTOR(S) : Kiyoshi Emori

It is certified that error appears in the above-identified patent and that said Letters Patent is hereby corrected as shown below:

In col. 9, line 32, change "cOmes" to --comes--.

In col. 9, line 37, change "." (period) to --,-- (comma).

In col. 9, line 38, change "step #2" to --[step #22]--.

In col. 9, lines 48 and 49, change "step #5" to --[step #51]--.

In col. 9, line 50, change "step #42) step #5" to --(step #42) [step #52]--.

In col. 11, line 33 (claim 1, last line), after "forming", insert --mode--.

In col. 12, line 43 (claim 10, line 3), change "comprises" to --comprised--.

In col. 13, line 7 (claim 12, last line), change "transports" to --transport--.

In col. 13, line 43 (claim 15, line 18), change "of" to --for--.

In col. 14, line 49 (claim 22, line 2), change "items" to --times--.

UNITED STATES PATENT AND TRADEMARK OFFICE

CERTIFICATE OF CORRECTION

PATENT NO. : 4,943,832

DATED : July 24, 1990

INVENTOR(S) : Kiyoshi Emori

It is certified that error appears in the above-identified patent and that said Letters Patent is hereby corrected as shown below:

In col. 15, line 2 (claim 22, last line), after "sheets", insert --corresponding to the result of the judgment made by the judging means--.

In col. 15, line 61 (claim 27, line 3), change "transporter" to --transport--.

In col. 16, line 63 (claim 32, line 2), change "of" to --for--.

In col. 16, last line (claim 32, line 7), change "as" to --a--.

In col. 17, line 12 (claim 32, last line), change ";" (semicolon) to --.-- (period).

In col. 17, line 19 (claim 33, line 7), change "of" to --for--.

Signed and Sealed this

Fifth Day of November, 1991

*Attest:*

HARRY F. MANBECK, JR.

*Attesting Officer*

*Commissioner of Patents and Trademarks*